US005375731A

United States Patent [19]

Jones

[11] Patent Number: 5,375,731

[45] Date of Patent: Dec. 27, 1994

[54] JUNCTION BOX LOCKING APPARATUS

[76] Inventor: Eugene E. Jones, 10100 Old Palafox Rd., Pensacola, Fla. 32534

[21] Appl. No.: 42,562

[22] Filed: Apr. 5, 1993

[51] Int. Cl.[5] ..... B65D 45/16

[52] U.S. Cl. ..... 220/326; 220/3.8; 220/284; 215/302; 292/DIG. 16

[58] Field of Search ..... 220/326, 3.8, 210, 284; 215/207, 302; 292/84, DIG. 16, DIG. 38

[56] References Cited

U.S. PATENT DOCUMENTS 742,563 10/1903 Beehler .
773,319 10/1904 Grossbeck .
893,248 7/1908 Kingston .
911,004 1/1909 Gano .
1,416,616 5/1922 Crane ..... 215/215 X
2,113,687 4/1938 Grace .
3,893,584 7/1975 Ledford .
4,291,817 9/1981 Spitzer et al. ..... 220/3.8 X
4,993,575 2/1991 Maes ..... 220/3.8
5,077,993 1/1992 Blair et al. .

*Primary Examiner*—Allan N. Shoap
*Assistant Examiner*—Jes F. Pascua
*Attorney, Agent, or Firm*—George A. Bode; Michael L. Hoelter

[57] ABSTRACT

A locking apparatus for a closure having a container and cover, the apparatus comprising a latch member mounted to the interior of the cover and a corresponding catch member mounted to the interior the container. A helical coil passes through a helical passageway at the closure for engaging and disengaging the latch and the catch members for unlocking and locking the closure.

20 Claims, 3 Drawing Sheets

JUNCTION BOX LOCKING APPARATUS

BACKGROUND OF THE INVENTION

1. Field of the Invention

This invention pertains to a locking apparatus for utility junction boxes and the like, and more particularly to a locking apparatus which utilizes a spring latch-type lock and a helical coil-type key.

2. General Background

Junction boxes are well used in the cable, telephone, water, and electrical industries, to name a few, to protect certain items from the elements. It is also well known to lock these junction boxes in order to both prevent any unauthorized access and to prevent any vandalism to their contents. However, easy access to these boxes must be provided in order to take readings, correct problems, or add new services as needed. Thus, these boxes must be constructed with a means of providing easy access to their contents by authorized personnel while restricting such access by unauthorized personnel. Additionally, the locking mechanism must be able to withstand abuse from both potential intruders and the weather so that they will be in proper operating order when access is desired.

Some past attempts to devise a lock for junction boxes and the like are illustrated in U.S. Pat. No. 2,113,687 to Grace, U.S. Pat. No. 3,893,584 to Ledford and U.S. Pat. No. 742,563 to Beehler. These patents all disclose a spring-type latch which requires a simple bar or rod to disengage the latch. Consequently, access to these boxes is not very restrictive.

U.S. Pat. No. 893,248 to Kingston and U.S. Pat. No. 911,004 to Gano are attempts to further limit access to a box by disclosing a latch mechanism which requires a threaded key for operation. While this will provide some degree of protection, a threaded key to operate these latches can be easily devised or located.

U.S. Pat. No. 773,319 to Grossbeck and U.S. Pat. No. 5,077,993 to Blair, et al., disclose latch mechanisms which require a more sophisticated key, or a special key, for proper operation. While these changes make unauthorized access to a box more difficult to achieve, it also can cause problems when authorized personnel lose or misplace their key. Such sophisticated keys are not easily re-made with their replacement cost being rather high due to their unique configuration.

It is thus an object of the present invention to provide a latching mechanism that is easily operated and which is weatherproof.

Another object of this invention is to provide a latching mechanism whose key is not easily ascertainable from the outside.

Still another object of this invention is to provide a novel key configuration so that potential unauthorized users cannot ascertain this configuration from an examination of the box.

Still another object of this invention is to provide a latching mechanism which can withstand abuse and whose key can be replaced without requiring elaborate manufacturing steps.

Still another object of this invention is to provide a latching mechanism that is relatively inexpensive to construct and which has few moving parts that can wear out, jam, or break.

Still another object of this invention is to provide a latching mechanism that can be modified to provide varying degrees of security such as by specifying the depth of penetration required for operation. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is disclosed is an internally mounted locking apparatus for a closure or covered box having a helical key for passing through a helical passageway at the closure for engaging and disengaging an internally mounted latch member and its corresponding catch member. The helical key is constructed and arranged to fit within this helical passageway and, upon rotation, is able to pass through the passageway so as to engage the latch and unlock and lock the closure.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
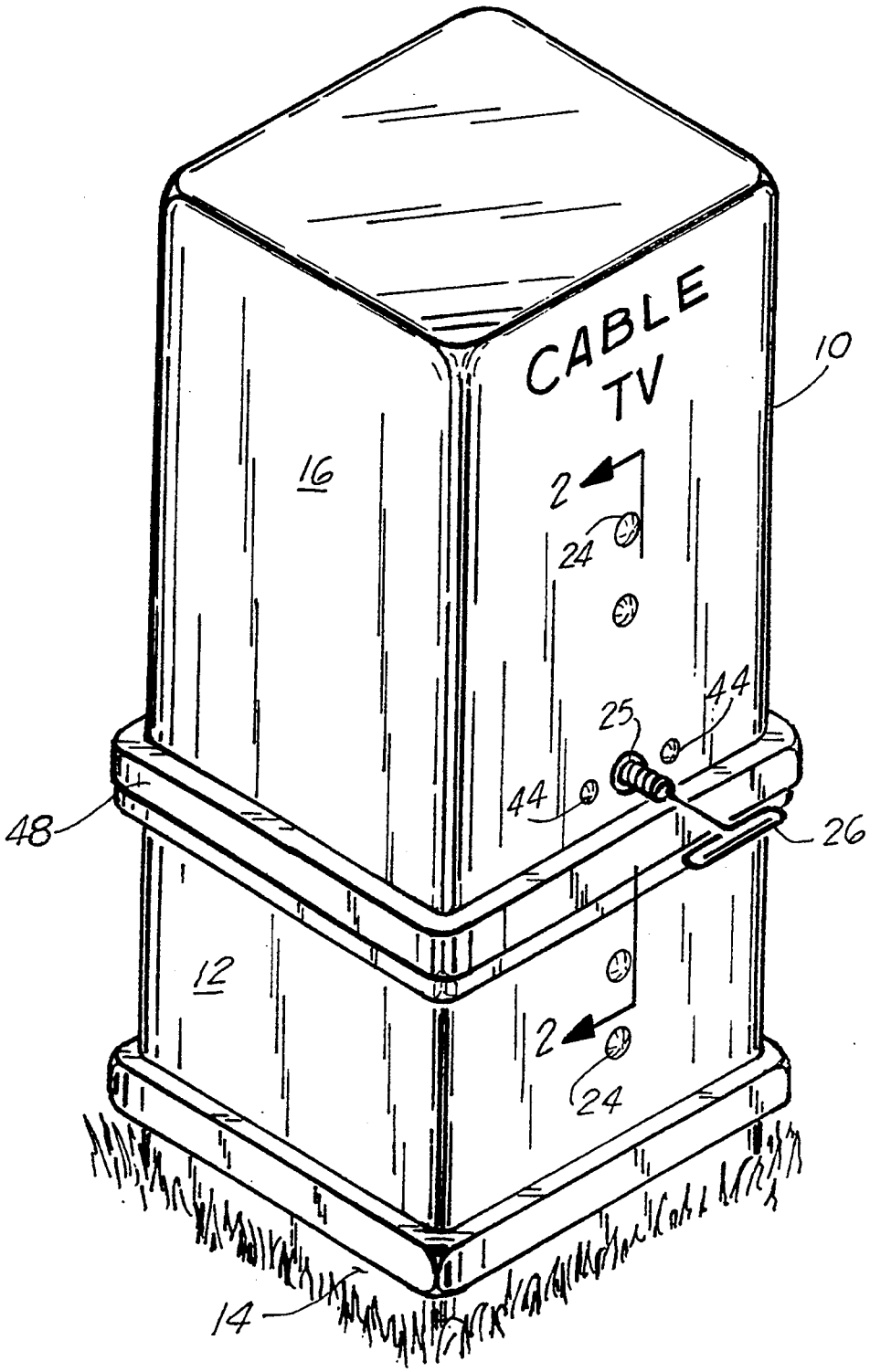
FIG. 1 is a pictorial view of a typical junction box held closed by the interiorly mounted locking apparatus of the preferred embodiment of the present invention.

FIG. 1 illustrates a typical junction box or closure 10 that may be used in the cable, electrical, telephone or other industries. Junction box or closure 10 generally consists of a lower base or container 12 secured to the ground such as by being mounted upon a platform 14 or the like. Extending upwardly within lower base 12 are the wires, cables, connectors, etc., (not shown) which junction box 10 both houses and protects. Sitting atop lower base 12 is upper removable cover 16. Whenever access to the interior of box 10 is desired, upper cover 16 is removed, afterwards cover 16 is replaced when such access is no longer desired. While the embodiment illustrated discloses an upwardly elongated junction box 10 that is secured to a platform 14 on the ground, other types or configurations of junction box 10 are equally suitable for use, such as wall or post mounted boxes.

Figure 2:
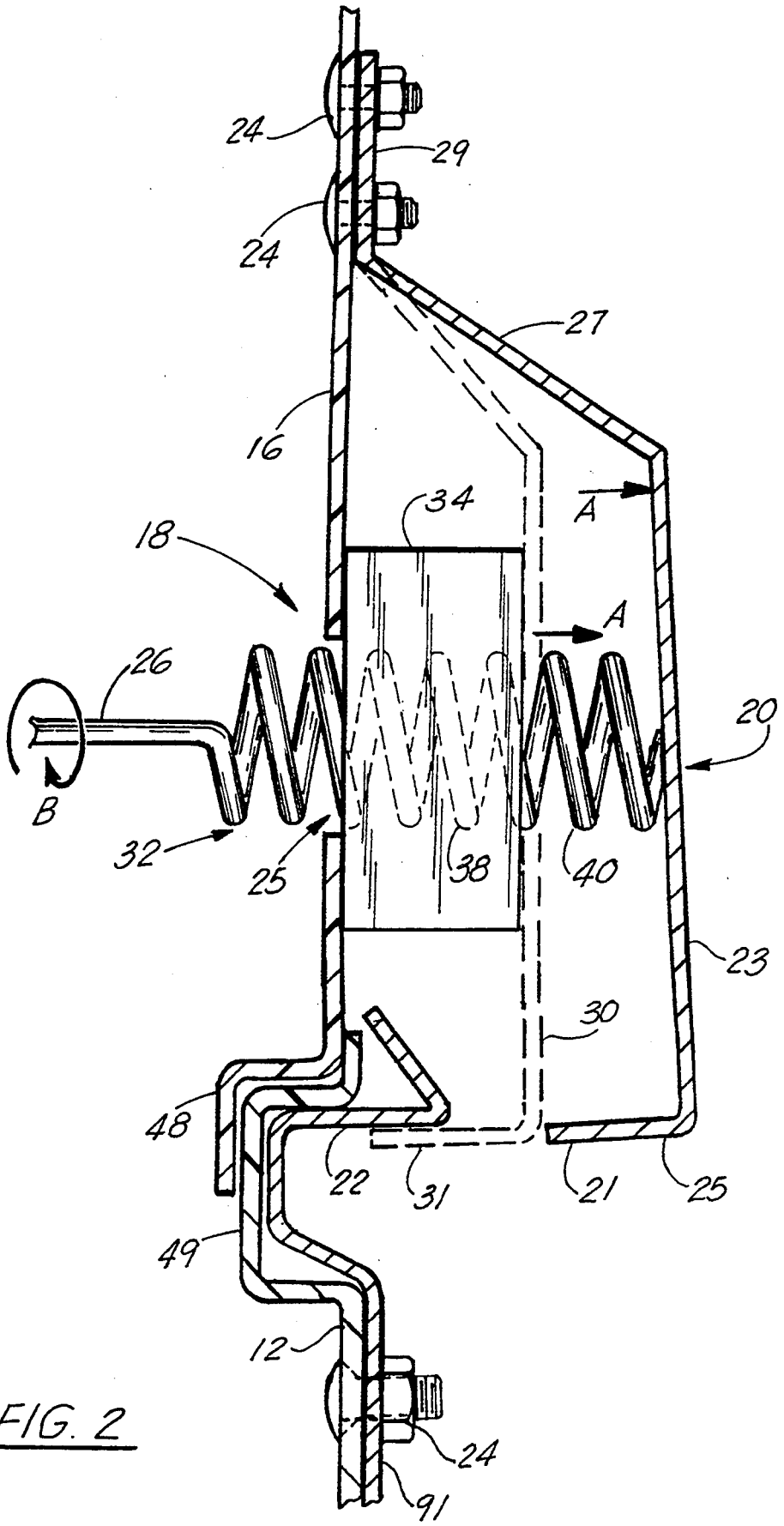
FIG. 2 is a sectional view, partially broken away, taken along LINES 2—2 of the embodiment of FIG. 1 (block 34 is not in section and helical passageway 38 is in PHANTOM)
Figure 3:
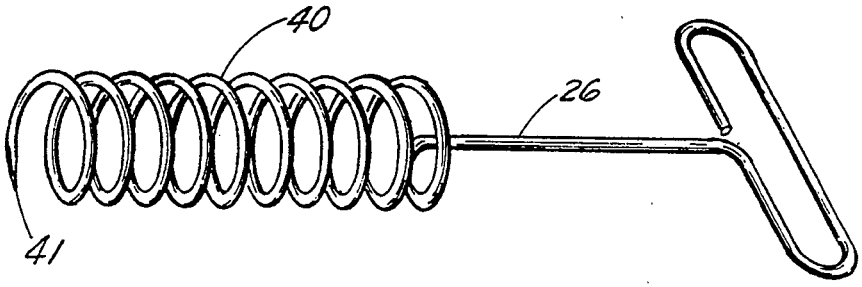
FIG. 3 is a pictorial view of the helical key to the locking apparatus contemplated by this invention.

FIG. 2 illustrates locking assembly or apparatus 18 which secures upper cover 16 to lower base 12. As shown, locking apparatus 18 is interiorly mounted to box 10 and is configured with a pivotal spring-type latch member 20 having side portions or members 25, 27 and an elongated base portion 23 (thereby forming a generally U-shaped member). Side member 25 has an end portion or integral hook 21 for engaging corresponding catch member 22. Both latch member 20 and catch member 22 are secured by nut and bolt combinations 24 interiorly of box 10, latch 20 being secured to cover 16 internally thereof, while catch 22 is secured to container 12 internally thereof. Latch 20 has side extension 29 for fastening to cover 16 and latch 22 has extension 91 for fastening to container 12. (In an alternate embodiment, latch member 20 can be secured to container 12 and catch member 22 to cover 16.) In order to operate locking assembly 18, an aperture 25 is provided in cover 16 and a helical coil or key 26, best seen in FIG. 3, is rotated through a helical passageway 38 provided in block 34 mounted at aperture 25 in upper cover 16. Key 26 engages latch 20 thereby urging it inwardly away from lower base 12 so as to release latch 20 from catch 22 (see ARROWS "A"). The normal, spring tension biased position of latch 20 and its end portion 21 are shown by phantom lines 30, 31 and, when latch 20 is in this phantom position 30, upper cover 16 is secured to lower base 12 as end portion 21 (31) engages catch 22. (In the alternate embodiment discussed above, aperture 25 and block 34 are placed in base 12.)

Figure 4:
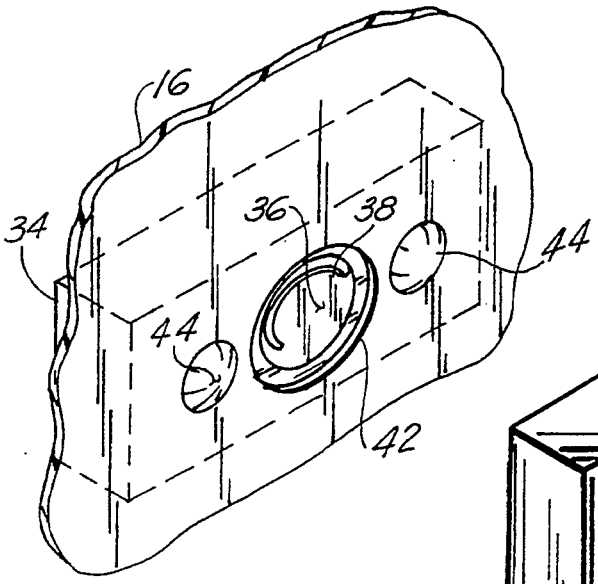
FIG. 4 is an enlarged pictorial view, partially broken away, of the blocking means of the locking apparatus of the embodiment of FIG. 1.
Figure 5:
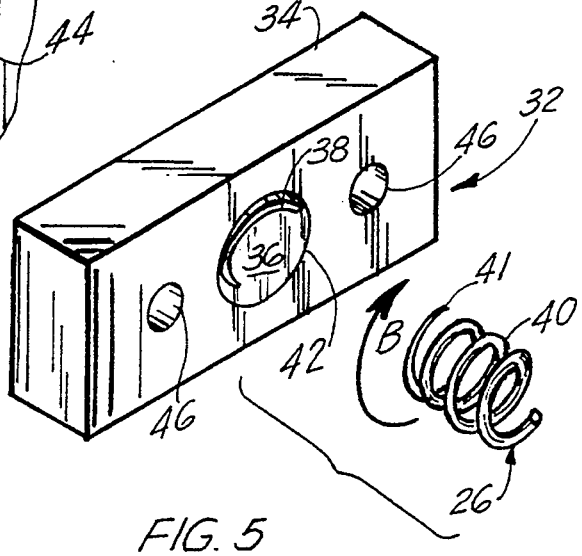
FIG. 5 is an enlarged pictorial view, partially broken away, illustrating the operation of the blocking means and key of the locking apparatus of the embodiment of FIG. 1; and, FIG. 6 is a side view, partially broken away, of the blocking means and key of the locking apparatus of the embodiment of FIG. 1, with the helical key inserted.
Figure 6:
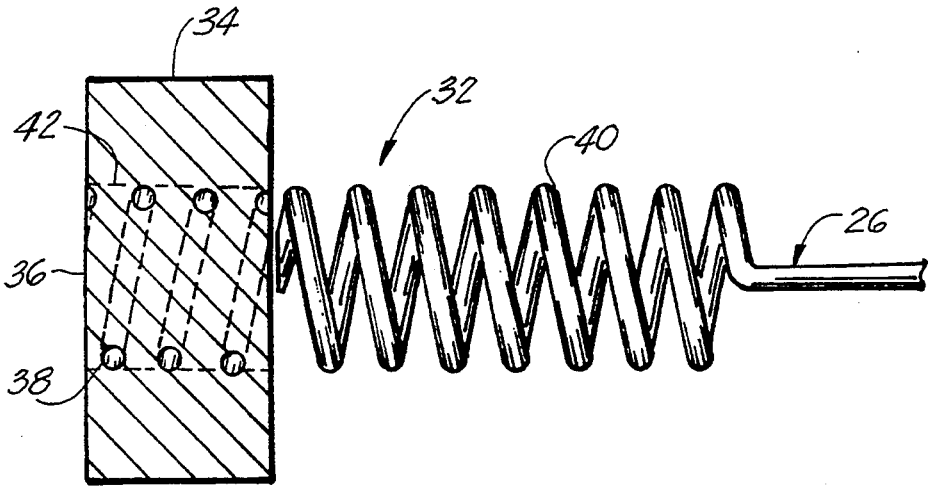

While spring-type latch and catch assemblies have previously existed, one novel feature of this locking assembly 18 is blocking means 32 (best seen in FIGS. 4–6). Blocking means 32 consists of solid metal block 34 having a center metal plug 36 filling an aperture 42 therein (aperture 42 in block 34 aligns with aperture 25 in cover 16 when block 34 is mounted to the interior of cover 16 by bolts 44 secured in threaded sink holes in block 34). Plug 36 is specially configured with externally accessible helical passageway or thread 38 that passes through it and is sized to match the helical spiral 40 of key 26. Spiral 40 has a pointed tip 41 for easy insertion into helical thread or passageway 38. Plug 36 is generally pressed or forced into the central, smooth-bored aperture 42 in block 34 thereby insuring a tight fit with little or no chance of coming loose.

To operate locking assembly 18 to unlock box 10, key 26 is threaded or rotated through helical passageway 38 in plug 36 in block 34 in the direction of ARROW "B." The helical spiral 40 of key 26 slides within helical thread or passageway 38 in plug 36 thereby permitting spiral 40 to pass through block 34. When such passage is accomplished, tip 41 of spiral 40 engages spring latch 20 along the interior of base 23 of the U-shaped member such that any continued rotation of key 26 in the direction of ARROW "B" will cause latch 20 to move away from catch 22 in the direction of ARROWS "A" thus unlocking box 10.

Because of this configuration, there will be no straight or in-line passageway through block 34. This will prevent any unauthorized access to the interior of box 10 such as by forcing a screwdriver or the like therethrough. Instead, the exterior of box 10 will merely disclose an aperture 25 (aligned with aperture 42 in block 34) having therein a metal plug 36 pressed into a metal block 34 with the only means of passage being helical thread 38.

To re-lock box 10, key 26 is rotated opposite ARROW "B" and key 26 disengages from base 23 and latch member 20 thereby biases to its normal position (the phantom position 30) of FIG. 2 and will thus re-engage catch member 22.

Block 34 can be secured to base 12 or it can be secured to cover 16 (whichever embodiment may be desired, although in the preferred embodiment of FIGS. 1, 2 and 4, it is secured to cover 16) via bolts 44 that pass through cover 16 and fasten in threaded sink holes 46 in block 34. In this fashion, block 34 can be securely attached to box 10 so as to block aperture 25 in cover 16.

To aid in the attachment of cover 16 to base 12, both such items are configured with mating lip portions 48, 49 around their respective perimeters to that cover 16 can rest upon base 12. When thusly placed, catch 22, which is shown as being secured to container 12, will engage latch 20 thereby automatically securing cover 16 to base 12. Only upon the release of latch 20 from catch 22 can junction box 10 become disassembled.

While the preferred embodiment disclosed above pertains to a junction box 10, locking apparatus 18 can be used on a variety of other devices that are to be kept closed or secured together, such as doors, windows, drawers, cabinets, chests, boxes or the like. The only important requirement is that block 34 must be capable of being secured to the interior of the locked device and access to helical passageway 38 must be provided by an aperture in the device.

The stiffness or bias of latch member 20 can vary depending upon the material used. If more resistance to key 26 is desired, an additional biasing means (such as a spring not shown) can be installed intermediate latch 20 and the opposing inner wall of cover 16. Thus, the bias of this additional member must also be overcome by key 26 before latch 20 can be disengaged from catch 22. Also, the length of side member 27 of latch member 20 determines the length of spiral 40 of key 26 that is required.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A locking apparatus for a closure having a container and cover members, there being an aperture in said closure, said locking apparatus comprising:

(a) a latch member mounted to the interior of one of said members of said closure and having an end portion adapted for hooking engagement with a catch member mounted to the interior of the other of said members of said closure;

(b) means for blocking said aperture, said means having a helical passageway therethrough; and, (c) means adapted to pass through said helical passageway upon rotation of said means and thereby engage said latch member to move said latch member out of and into engagement with said catch member, thereby unlocking and locking said closure.

2. The apparatus of claim 1, wherein said means adapted to pass through said helical passageway is a helical coil.

3. The apparatus of claim 1, wherein said means for blocking said aperture is a solid member mounted to the interior of said one of said members of said closure to which said latch member is mounted.

4. The apparatus of claim 1, wherein said latch member is normally biased to a first position for hooking engagement with said catch member.

5. The apparatus of claim 1, wherein said latch member is mounted to the interior of said cover member of said closure and said catch member is mounted to the interior of said container member of said closure.

6. The apparatus of claim 1, wherein said latch member comprises a generally U-shaped member having side members and an elongated base portion, said latch member being mounted to the interior of said one member of said closure at the end portion of one of said side members and whereby the opposing side member forms said end portion adapted for hooking engagement with said catch member.

7. The apparatus of claim 1, wherein said latch member is mounted to the interior of said container member of said closure and said catch member is mounted to the interior of said cover member of said closure.

8. The apparatus of claim 6, wherein said helical passageway terminates adjacent said latch member.

9. The apparatus of claim 7, wherein said means adapted to pass through said helical passageway engages said U-shaped latch member along said base portion thereof.

10. A locking apparatus for a closure having a container and cover members, there being an aperture in said closure, said locking apparatus comprising:

(a) a latch member mounted to the interior of one of said members of said closure and having an end portion adapted for and normally biased toward hooking engagement with a catch member mounted to the interior of the other of said members of said closure;

(b) means mounted to the interior of one of said members of said closure and adjacent said latch member for blocking said for aperture, said means having a helical passageway therethrough; and, (c) helical coil adapted to pass through said helical passageway upon rotation of said coil and thereby engage said latch member to move said latch member out of and into engagement with said catch member, thereby unlocking and locking said closure.

11. The apparatus of claim 10, wherein said means for blocking said aperture is a solid member mounted to the interior of said one of said members of said closure to which said latch member is mounted.

12. The apparatus of claim 10, wherein said latch member is mounted to the interior of said cover member of said closure and said catch member is mounted to the interior of said container member of said closure.

13. The apparatus of claim 10, wherein said latch member comprises a generally U-shaped member having side members and an elongated base portion, said latch member being mounted to the interior of said one member of said closure at the end portion of one of said side members and whereby the opposing side member forms said end portion adapted for hooking engagement with said catch member.

14. The apparatus of claim 13, wherein said helical passageway terminates adjacent said latch member.

15. The apparatus of claim 14, wherein said helical coil engages said U-shaped latch member along said base portion thereof.

16. The apparatus of claim 10, wherein said latch member is mounted to the interior of said container member of said closure and said catch member is mounted to the interior of said cover member of said closure.

17. A locking apparatus for a closure having a container and cover members, there being an aperture in said closure, said locking apparatus comprising:

(a) a latch member mounted to the interior of one of said members of said closure and having an end portion adapted for and normally biased toward hooking engagement with a catch member mounted to the interior of the other of said members of said closure;

(b) means mounted to the interior of said one of said members of said closure to which said latch member is mounted and adjacent said latch member for blocking said aperture, said means having a helical passageway therethrough; and, (c) helical coil adapted to pass through said helical passageway upon rotation of said coil and thereby engage said latch member to move said latch member out of and into engagement with said catch member, thereby unlocking and locking said closure.

18. The apparatus of claim 17, wherein said latch member comprises a generally U-shaped member having side members and an elongated base portion, said latch member being mounted to the interior of said one member of said closure at the end portion of one of said side members and whereby the opposing side member forms said end portion adapted for hooking engagement with said catch member.

19. The apparatus of claim 18, wherein said helical coil engages said U-shaped latch member along said base portion thereof.

20. The apparatus of claim 19, wherein said latch member is mounted to the interior of said container member of said closure and said catch member is mounted to the interior of said cover member of said closure.

* * * * *